United States Patent [19]

Campbell et al.

[11] 4,270,930

[45] Jun. 2, 1981

[54] CLEAN COMBUSTION CHAMBER FUEL COMPOSITION

[75] Inventors: Curtis B. Campbell, Pinole; Richard J. Peyla, Emeryville, both of Calif.

[73] Assignee: Chevron Research Company, San Francisco, Calif.

[21] Appl. No.: 106,348

[22] Filed: Dec. 21, 1979

[51] Int. Cl.[3] ..... C10L 1/18; C10L 1/22

[52] U.S. Cl. ..... 44/71; 44/77

[58] Field of Search ..... 44/71, 77

[56] References Cited

U.S. PATENT DOCUMENTS

| | | | |
|---|---|---|---|
| 4,160,648 | 7/1979 | Lewis et al. | 44/63 |
| 4,197,409 | 4/1980 | Lilburn | 44/71 |

*Primary Examiner*—Winston A. Douglas
*Assistant Examiner*—J. V. Howard
*Attorney, Agent, or Firm*—D. A. Newell; S. R. LaPaglia; A. S. Zavell

[57] ABSTRACT

A fuel composition for gasoline engines which keeps combustion chambers clean, does not contribute to octane requirement increase and even serves to decrease the octane requirements of an engine which has undergone octane requirement increase while operating on other fuel compositions. The fuel composition comprises a major amount of gasoline and at least 0.4 weight percent of a hydrocarbyl poly(oxyalkylene) aminocarbamate.

10 Claims, No Drawings

CLEAN COMBUSTION CHAMBER FUEL COMPOSITION

BACKGROUND OF THE INVENTION

1. Field of the Invention

A new gasoline engine with clean combustion chamber surfaces requires a certain minimum octane fuel in order to operate satisfactorily without pinging or knocking. As hours of operation are accumulated on ordinary fuel compositions, this minimum octane increases in conjunction with the accumulation of combustion chamber deposits, until finally, an equilibrium state is achieved at a minimum octane requirement as high as 6–8 or more octane numbers greater than that for the new engine with clean combustion chamber surfaces. This increase in minimum octane requirement is known as octane requirement increase (ORI). The ORI problem is compounded by certain intake system deposit control additives used in unleaded gasolines, wherein the ORI can be larger and more rapid than even the unleaded base fuel alone.

2. DESCRIPTION OF THE PRIOR ART

U.S. Pat. No. 4,160,648 describes an intake system deposit control additive for fuels which is a hydrocarbyl poly(oxyalkylene) aminocarbamate and which, when used in amounts of 30–2,000 ppm in gasoline fuels, does not itself appreciably contribute to ORI or combustion chamber deposits.

SUMMARY OF THE INVENTION

A fuel composition comprising a major amount of hydrocarbons boiling in the gasoline range and from 0.3 to 3 weight percent of a hydrocarbyl poly(oxyalkylene) aminocarbamate of molecular weight from about 600 to about 10,000 having at least one basic nitrogen atom, wherein said hydrocarbyl group contains from 1 to 30 carbon atoms.

DETAILED DESCRIPTION OF THE INVENTION

The high concentration aminocarbamate fuel composition of the present invention keeps combustion chambers clean, i.e., the combustion chamber is free of deposits normally found in the combustion chamber of operating engines. Furthermore, the fuel composition is superior to the base fuel alone in that there is no ORI in clean engines operated on this fuel composition. The intake system deposit control which is available at lower concentrations of aminocarbamate in fuel compositions is also present in the fuel composition of the present invention. An unexpected and valuable property of the high concentration aminocarbamate fuel composition of this invention is its ability to decrease the octane requirement (ORD) of engines which have undergone ORI while operated on other fuel compositions.

Amine Component

The amine moiety of the hydrocarbyl-terminated poly(oxyalkylene) aminocarbamate is preferably derived from a polyamine having from 2 to about 12 amine nitrogen atoms and from 2 to about 40 carbon atoms. The polyamine is preferably reacted with a hydrocarbyl poly(oxyalkylene) chloroformate to produce the hydrocarbyl poly(oxyalkylene) aminocarbamate fuel additive finding use within the scope of the present invention. The chloroformate is itself derived from hydrocarbyl poly(oxyalkylene) alcohol by reaction with phosgene. The polyamine, encompassing diamines, provides the product poly(oxyalkylene) aminocarbamate with, on the average, at least about one basic nitrogen atom per carbamate molecule, i.e., a nitrogen atom tritratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The polyamine component of the present invention has been described and exemplified more fully in copending application Ser. No. 917,149 filed June 19, 1978.

Hydrocarbyl, as used in describing all the components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acethylenic unsaturation. The more preferred polyamine finding use for the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylene triamine, triethylene tetramine, di(trimethylene) triamine, dipropylene triamine, tetraethylene pentamine, etc. Among the polyalkylene polyamines are polyethylene polyamine, polypropylene polyamine containing 2–12 amine nitrogen atoms and 2–24 carbon atoms are especially preferred and in particular, the lower polyalkylene polyamines, e.g., ethylenediamine, dipropylene triamine, etc., are most preferred.

Poly(oxyalkylene) Component

The hydrocarbyl-terminated poly(oxyalkylene) polymers which are utilized in preparing the carbamates of the present invention are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. The hydrocarbyl-terminated poly(oxyalkylene) alcohols are produced by the addition of lower alkylene oxides, such as oxirane, ethylene oxide, propylene oxide, butylene oxide, etc. to the hydroxy compound ROH under polymerization conditions, wherein R is the hydrocarbyl groups which caps the poly(oxyalkylene) chain. In the poly(oxyalkylene) component of the present invention, the group R will generally contain from 1 to about 30 carbon atoms, preferably from 2 to about 20 carbon atoms and is preferably aliphatic or aromatic, i.e., an alkyl or alkyl phenyl wherein the alkyl is a straight or branched-chain of from 1 to about 24 carbon atoms. The oxyalkylene units in the poly(oxyalkylene) component preferably contain from 2 to about 5 carbon atoms but one or more units of a larger carbon number may also be present. The poly(oxyalkylene) component of the present invention is more fully described and exemplified in copending application Ser. No. 917,149 filed June 19, 1978 and 931,232 filed Aug. 8, 1978.

Aminocarbamate

The poly(oxyalkylene) aminocarbamate fuel additive used in compositions of the present invention is obtained by linking the amine component and the poly(oxyalkylene) component together through a carbamate linkage, i.e., $$-O-C(O)-\overset{|}{N}-,$$

wherein the oxygen may be regarded as the terminal hydroxyl oxygen of the poly(oxyalkylene) alcohol component, and the carbonyl group, —C(O)—, is preferably provided by a coupling agent, e.g., phosgene. In the preferred method of preparation the hydrocarbyl poly(oxyalkylene) alcohol is reacted with phosgene to produce a chloroformate and the chloroformate is reacted with the polyamine. The carbamate linkages are formed as the poly(oxyalkylene) chains are bound to the nitrogen of the polyamine to the oxycarbonyl group of the chloroformate. Since there may be more than one nitrogen atom of the polyamine which is capable of reacting with the chloroformate, the aminocarbamate contains at least one hydrocarbyl poly(oxyalkylene) polymer chain bonded through an oxycarbonyl group to a nitrogen atom of the polyamine, but the carbonate may contain from 1 to 2 or more such chains. It is preferred that the hydrocarbyl poly(oxyalkylene) aminocarbamate product contains, on the average, about 1 poly(oxyalkylene) chain per molecule (i.e., is a monocarbamate), although it is understood that this reaction route may lead to mixtures containing appreciable amounts of di- or higher poly(oxyalkylene) chain substitution on a polyamine containing several reactive nitrogen atoms. Several especially preferred aminocarbamates are butylpoly(oxyalkylene)-N-(2-aminoethyl) carbamate and alkylphenyl-poly(oxyalkylene)-N-(2-aminoethyl) carbamate. Synthetic methods to avoid higher degrees of substitution, methods of preparation, and other characteristics of the aminocarbamate used in the present invention are more fully described and exemplified in copending application Ser. No. 917,149 filed June 19, 1978 and 931, 232 filed Aug. 8, 1978.

Fuel Compositions

The fuel compositions of the present invention contain a major amount of hydrocarbons boiling in the gasoline range and from 0.3 to 3 weight percent of the hydrocarbyl poly(oxyalkylene) aminocarbamate. Preferably the fuel compositions contain from 0.4 to about 2 weight percent of aminocarbamate and most preferably they contain from 0.5 to about 1 weight percent aminocarbamate. The former amount is generally sufficient to provide clean combustion chamber operation of a spark-ignited gasoline engine and to eliminate or prevent ORI. Larger concentrations may be necessary to effect ORD in engines which have undergone ORI while operated on other fuel compositions.

In gasoline fuels, other fuel additives are also included such as anti-knock agents, lead scavengers, antioxidants, demulsifiers, etc.

What is claimed is:

1. A fuel composition comprising a major amount of hydrocarbons boiling in the gasoline range and from 0.3 to 3 percent by weight of a hydrocarbyl poly(oxyalkylene) aminocarbamate of molecular weight from about 600 to about 10,000 having at least one basic nitrogen atom, and wherein said hydrocarbyl group contains from 1 to about 30 carbon atoms.

2. The fuel composition of claim 1 in which at least one basic nitrogen atom in said aminocarbamate is in a primary or secondary amino group.

3. The fuel composition of claim 1 in which each said oxyalkylene units is selected from 2 to 5 carbon oxyalkylene units of which at least a sufficient number are branched-chain oxyalkylene units to render said carbamate soluble in said fuel composition.

4. The fuel composition of claim 3 in which said oxyalkylene units are oxybutylene.

5. The fuel composition of claim 1 in which said hydrocarbyl group is an alkylphenyl group.

6. The fuel composition of claim 5 in which the alkyl in said alkylphenyl group is propylene tetramer.

7. The fuel composition of claim 1 wherein the amine moiety of said aminocarbamate is derived from polyamine having from 2 to 12 amine nitrogen atoms and from 2 to 40 carbon atoms with a carbon:nitrogen ratio between 1:1 and 10:1.

8. The fuel composition of claim 7 in which said polyamine is a polyalkylene polyamine wherein the alkylene group contains from 2 to 6 carbon atoms and the polyamine contains 2 to 12 amine nitrogen atoms and 2 to 24 carbon atoms.

9. The fuel composition of claim 8 in which said polyalkylene polyamine is selected from the group consisting of ethylene diamine, polyethylene polyamine, propylene diamine and polypropylene polyamine.

10. The fuel composition of claim 1 in which said hydrocarbyl poly(oxyalkylene) aminocarbamate is selected from butylpoly(oxypropylene)-N-(2-aminoethyl)carbamate and alkylphenyl poly(oxyisobutylene)-N-(2-aminoethyl)carbamate.

* * * * *